US008341821B2

(12) United States Patent
Honeycutt

(10) Patent No.: US 8,341,821 B2
(45) Date of Patent: Jan. 1, 2013

(54) FALL RESTRAINT EQUIPMENT COMPONENTS AND METHOD FOR MANUFACTURING THE SAME

(75) Inventor: Robert W. Honeycutt, Pawleys Island, SC (US)

(73) Assignee: SafeRack, LLC, Andrews, SC (US)

( * ) Notice: Subject to any disclaimer, the term of this patent is extended or adjusted under 35 U.S.C. 154(b) by 590 days.

(21) Appl. No.: 12/537,842

(22) Filed: Aug. 7, 2009

(65) Prior Publication Data

US 2010/0032633 A1 Feb. 11, 2010

Related U.S. Application Data

(60) Provisional application No. 61/087,732, filed on Aug. 10, 2008.

(51) Int. Cl.
*B21D 39/00* (2006.01)
*E04H 17/14* (2006.01)

(52) U.S. Cl. ..... 29/521; 256/59

(58) Field of Classification Search ..... 29/521, 29/897, 897.3, 428, 525, 557, 34 R, 558; 256/59, 65.02, 24, 32, 65.09, 65.14
See application file for complete search history.

(56) References Cited

U.S. PATENT DOCUMENTS

| | | | | |
|---|---|---|---|---|
| 309,320 | A | 12/1884 | Stockbridge | |
| 540,192 | A | 5/1895 | Rosback | |
| 903,157 | A | 11/1908 | Allen | |
| 981,613 | A | 1/1911 | Carter | |
| 1,505,116 | A | 8/1924 | Wiebe | |
| 1,815,048 | A | 7/1931 | Chambers | |
| 1,944,159 | A | 1/1934 | Bailey | |
| 2,326,844 | A | 8/1943 | Ely | |
| 3,095,848 | A | 7/1963 | Adolph | |
| 3,869,109 | A | 3/1975 | Russo | |
| 4,072,294 | A | 2/1978 | Densen | |
| 4,106,150 | A | 8/1978 | Irwin | |
| 4,133,283 | A | 1/1979 | Ryan | |
| 4,149,701 | A * | 4/1979 | Densen | 256/65.03 |
| 4,154,318 | A | 5/1979 | Malleone | |
| 4,161,795 | A | 7/1979 | Quest | |
| 4,168,764 | A | 9/1979 | Walters | |

(Continued)

FOREIGN PATENT DOCUMENTS

GB 2275632 9/1994

OTHER PUBLICATIONS

PCT International Search Report and Written Opinion of the International Searching Authority dated Feb. 6, 2009 for PCT/US2008/85922 filed on Dec. 8, 2008, corresponding to co-pending U.S. Appl. No. 12/329,883.

(Continued)

*Primary Examiner* — John C Hong
(74) *Attorney, Agent, or Firm* — Nelson Mullins Riley & Scarborough LLP; R. Brian Drozd

(57) ABSTRACT

A handrail or a swing gate for fall restraint equipment comprising an outer rail constructed from a single, continuous piece of tubular metal, a midrail constructed from a single, continuous piece of tubular metal, and a toeboard constructed from a single, continuous piece of sheet metal, where the outer rail is constructed to receive portions of the midrail and toeboard for an integral construction.

17 Claims, 18 Drawing Sheets

U.S. PATENT DOCUMENTS

| | | | | |
|---|---|---|---|---|
| 4,280,243 | A | 7/1981 | Durrant | |
| 4,335,803 | A | 6/1982 | Sugito | |
| 4,712,264 | A | 12/1987 | Voith | |
| 4,768,497 | A | 9/1988 | Winge | |
| 4,838,735 | A | 6/1989 | Warner | |
| 5,010,614 | A | 4/1991 | Braemert et al. | |
| 5,077,852 | A | 1/1992 | Karlsson | |
| 5,097,787 | A | 3/1992 | Bruce | |
| 5,319,818 | A | 6/1994 | Baranowski | |
| 5,402,546 | A | 4/1995 | Baranowski | |
| 5,794,292 | A | 8/1998 | Ricci, Jr. | |
| 5,950,266 | A | 9/1999 | Streeter et al. | |
| 5,994,667 | A | 11/1999 | Merdan et al. | |
| 6,170,609 | B1 * | 1/2001 | Dech | 182/187 |
| 6,425,572 | B1 | 7/2002 | Lehr | |
| 6,526,614 | B2 | 3/2003 | Anderson et al. | |
| 6,813,792 | B2 | 11/2004 | Miller | |
| 6,923,140 | B1 | 8/2005 | Cook | |
| 7,010,825 | B1 | 3/2006 | Finch Salas et al. | |
| 7,159,261 | B2 | 1/2007 | Carrigan | |
| 7,309,844 | B2 | 12/2007 | Lajoie | |
| 7,383,600 | B2 | 6/2008 | Carrigan | |
| 2002/0066290 | A1 | 6/2002 | Chen | |
| 2002/0189177 | A1 | 12/2002 | Eve et al. | |
| 2004/0107519 | A1 | 6/2004 | Grody | |
| 2007/0161460 | A1 | 7/2007 | Katz et al. | |
| 2007/0278041 | A1 * | 12/2007 | Cosgrove | 182/113 |
| 2009/0144916 | A1 | 6/2009 | Honeycutt | |
| 2010/0031455 | A1 | 2/2010 | Honeycutt et al. | |
| 2010/0031456 | A1 | 2/2010 | Honeycutt | |
| 2010/0032633 | A1 | 2/2010 | Honeycutt | |

OTHER PUBLICATIONS

PCT International Search Report and Written Opinion of the International Searching Authority dated Sep. 24, 2009 for PCT/US2009/053285 filed on Aug. 10, 2009, corresponding to co-pending U.S. Appl. No. 12/468,704.

PCT International Search Report and Written Opinion of the International Searching Authority dated Sep. 24, 2009 for PCT/US2009/053299 filed on Aug. 10, 2009, corresponding to co-pending U.S. Appl. No. 12/487,408.

PCT International Search Report and Written Opinion of the International Searching Authority dated Sep. 28, 2009 for PCT/US2009/053313 filed on Aug. 10, 2009, corresponding to co-pending U.S. Appl. No. 12/537,842.

Office Action issued by the U.S. Patent and Trademark Office on Oct. 4, 2010 for copending U.S. Appl. No. 12/487,408.

Office Action issued by the U.S. Patent and Trademark Office on Aug. 13, 2010 for copending U.S. Appl. No. 12/329,883, filed Dec. 8, 2008.

Office Action issued by the U.S. Patent and Trademark Office on Jun. 12, 2012 pending U.S. Appl. No. 12/537,842.

* cited by examiner

FALL RESTRAINT EQUIPMENT COMPONENTS AND METHOD FOR MANUFACTURING THE SAME

CLAIM OF PRIORITY

The present application claims the benefit of the U.S. provisional patent application filed on Aug. 10, 2008 by Robert W. Honeycutt for COMPONENTS OF SAFETY EQUIPMENT AND METHODS FOR MANUFACTURING THE SAME (Ser. No. 61/087,732), the entire disclosure of which is hereby incorporated by reference as if set forth verbatim herein.

FIELD OF THE INVENTION

The present invention relates generally to fall restraint equipment components. More particularly, the present invention relates to handrails and swing gates for fall restraint equipment.

BACKGROUND OF THE INVENTION

FIG. 1 illustrates an example of fall restraint equipment 100 comprising a stairwell 102, a platform 104, handrails 106, and a gangway 108. Stairwell 102 ascends to platform 104, where gangway 108 is connected. An optional cage 110 may be connected to gangway 108 if desired. Handrails 106 are located on the sides of platform 104 that are not connected to either gangway 108 or stairwell 102 in order to prevent a user from proceeding in a direction from the platform that does not lead to the gangway or the stairwell. In this example, the fall restraint equipment provides a user with access to a top 112 of a container 114 (such as a railway car).

Referring to FIG. 2, handrail 106 is typically manufactured by cutting or drilling stock materials into a desired size and then welding the cut pieces together. For instance, side beams 200 and cross beams 202 are cut from tubular pieces of steel. Cross beams 202 are welded to side beams 200 denoted by welds 204. In this example, beams 200 and 202 are welded at areas 204 wherever the beams intersect. Because the stock materials are typically not designed for the intended use of the pieces, they must be drilled or cut to match the specifications of the pieces' end use. Manufacturing a handrail, such as handrail 22, in this manner is both time-consuming and costly. Additionally, the drilling and cutting of the stock material must be accomplished with precision in order to create a stable end product. Variances greater than an acceptable level render the smaller pieces unusable, which are typically discarded as they often are unusable in another product once they have been drilled or cut. Additionally, if other parts cannot be cut or drilled from the remaining portions of the stock materials, they too are discarded. This also increases the costs associated with manufacturing the end product, such as handrails 106.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
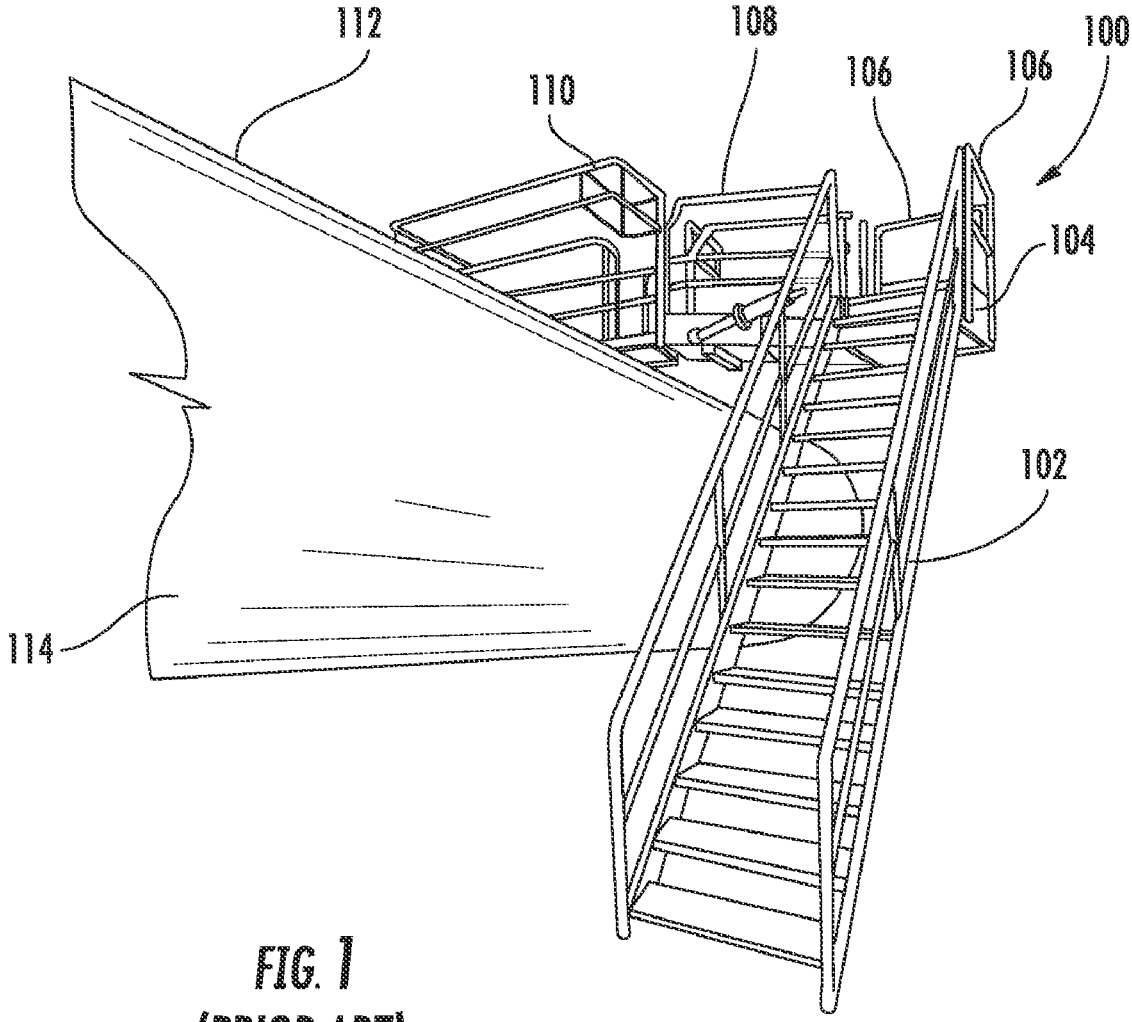
FIG. 1 (PRIOR ART)
FIG. 1 is a perspective view of an exemplary fall restraint system.
Figure 2:
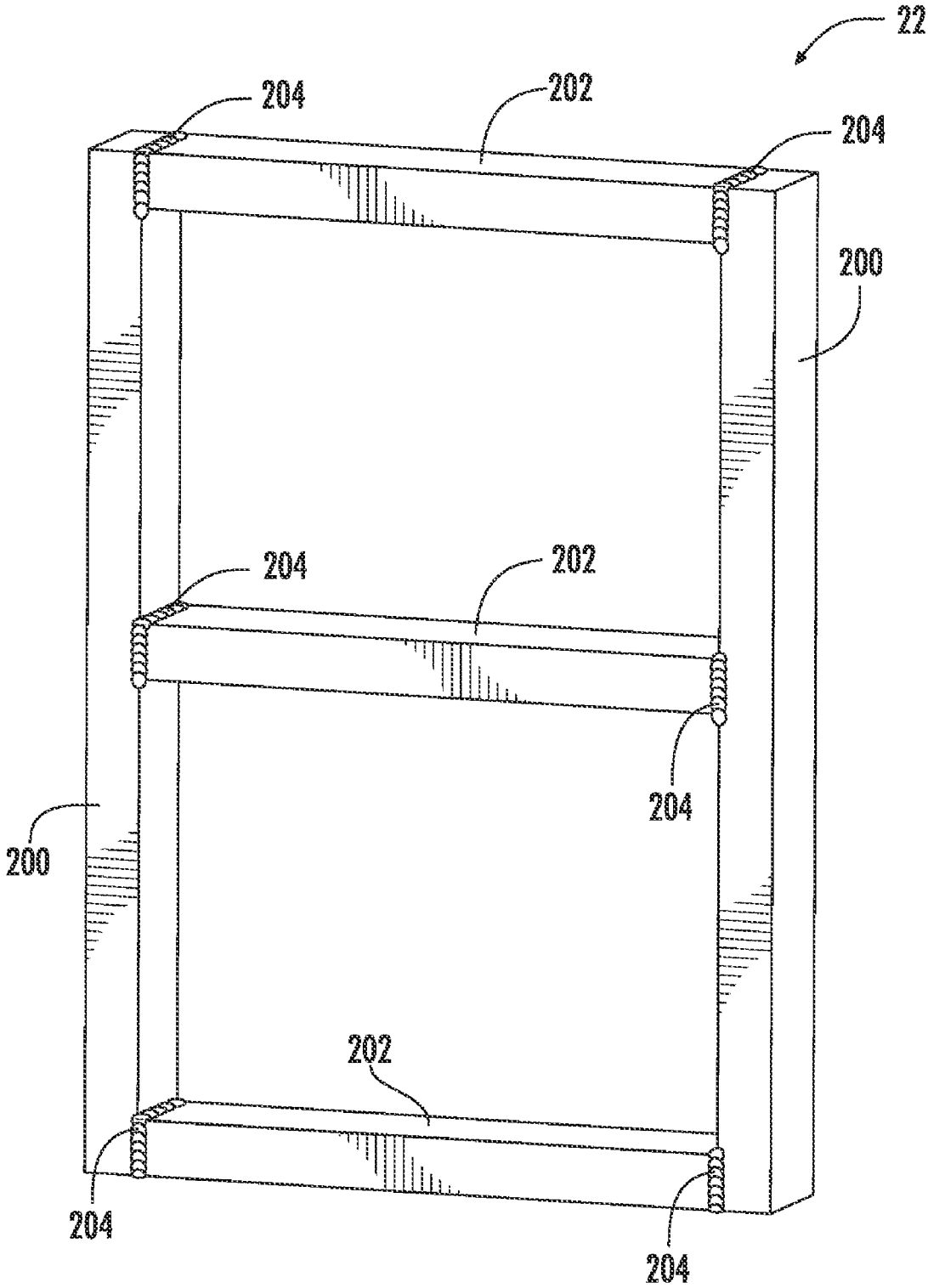
FIG. 2 (PRIOR ART)
FIG. 2 is a perspective view of an exemplary handrail that may be used in the system of FIG. 1.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 3:
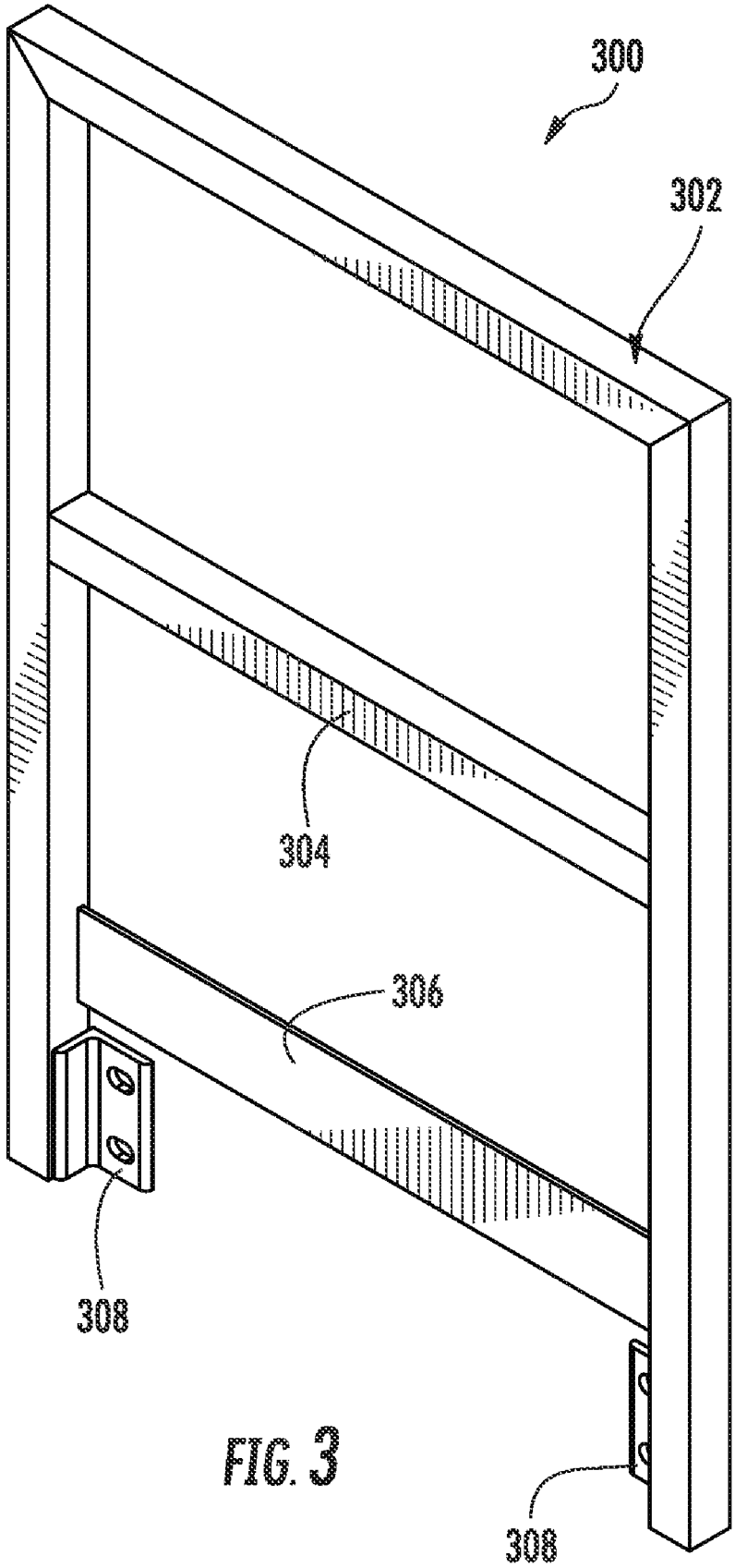
FIG. 3 is a perspective view of a handrail in accordance with an embodiment of the present invention.
Figure 4:
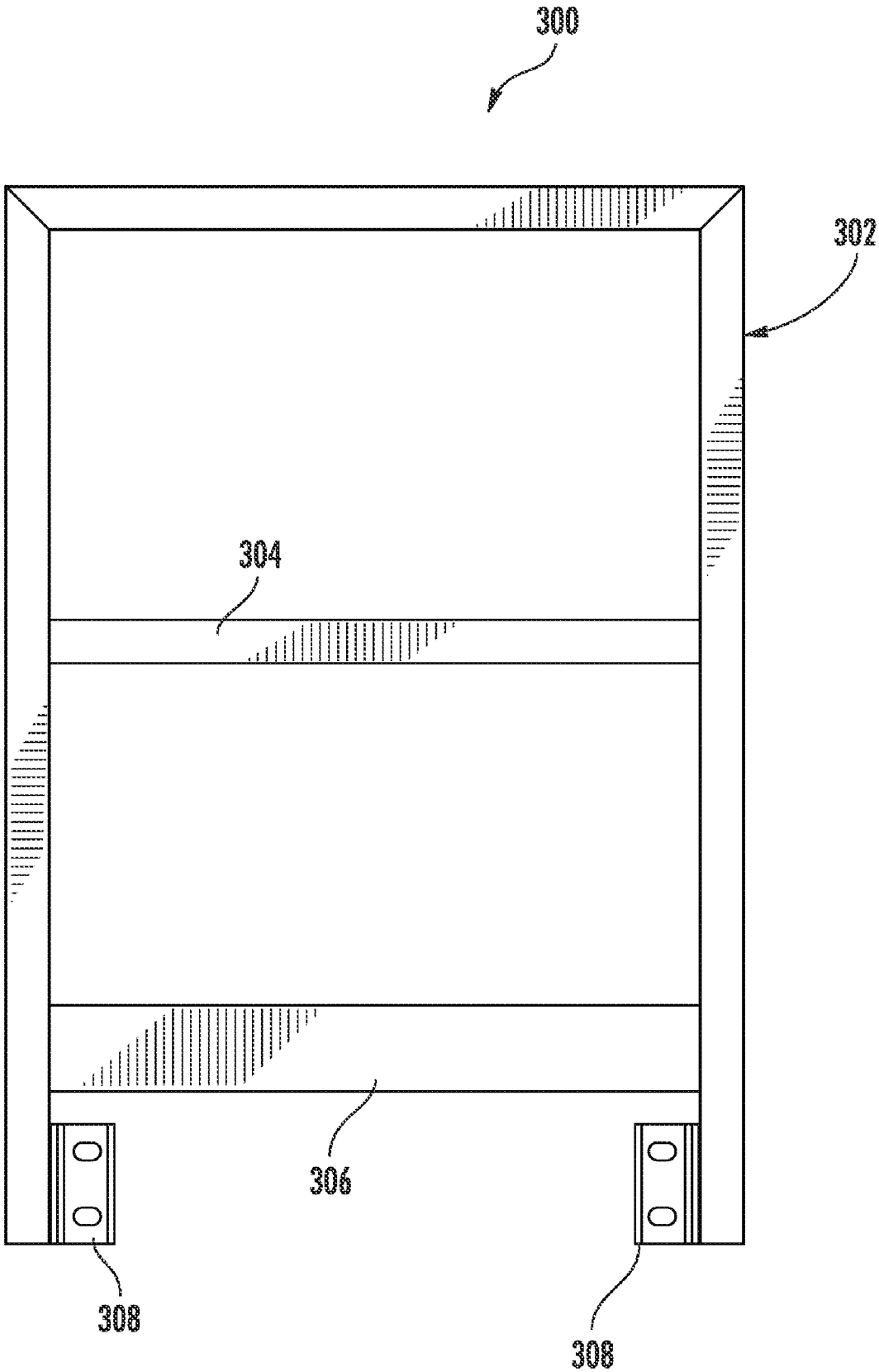
FIG. 4 is a front elevation view of the handrail of FIG. 3.

FIGS. 3 and 4 are perspective and front elevation views, respectively, of a handrail 300 that may be substituted for handrail 22 of the fall restraint equipment of FIG. 1. Handrail 300 comprises an outer rail 302, a midrail 304, and a toeboard 306. Optionally, a pair of brackets 308 may be attached to handrail 300 by welding the brackets to the inside of outer rail 302. Brackets may be used to secure handrail 300 to a fixed structure, such as platform 18 (FIG. 1), a walkway, or other passageway. It should be understood by those of ordinary skill in the art that handrail 300 may be secured to a fixed structure by other suitable means, such as by inserting the handrail into the material forming the structure. For example, handrail 300 may be inserted into the concrete that forms a walkway before the concrete hardens. In such an embodiment, brackets 308 are unnecessary and not welded to outer rail 302 or, alternatively, used to secure handrail 300 to the material in which the handrail has been inserted, such as concrete, for additional stability.

Figure 5:
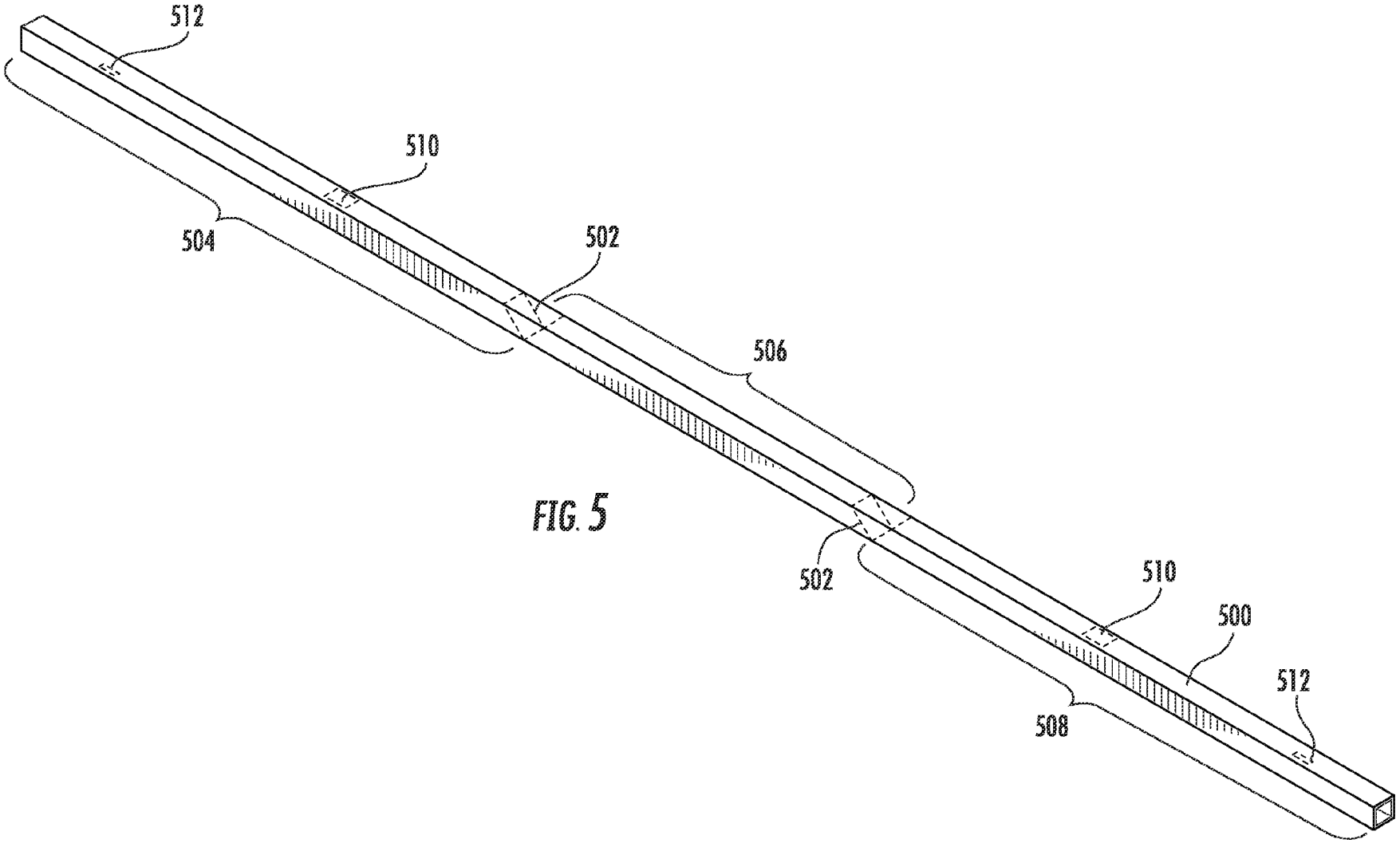
FIG. 5 is a perspective view of a continuous piece of tubular metal configured to form the outer rail of the handrail of FIGS. 3 and 4.
Figure 6:
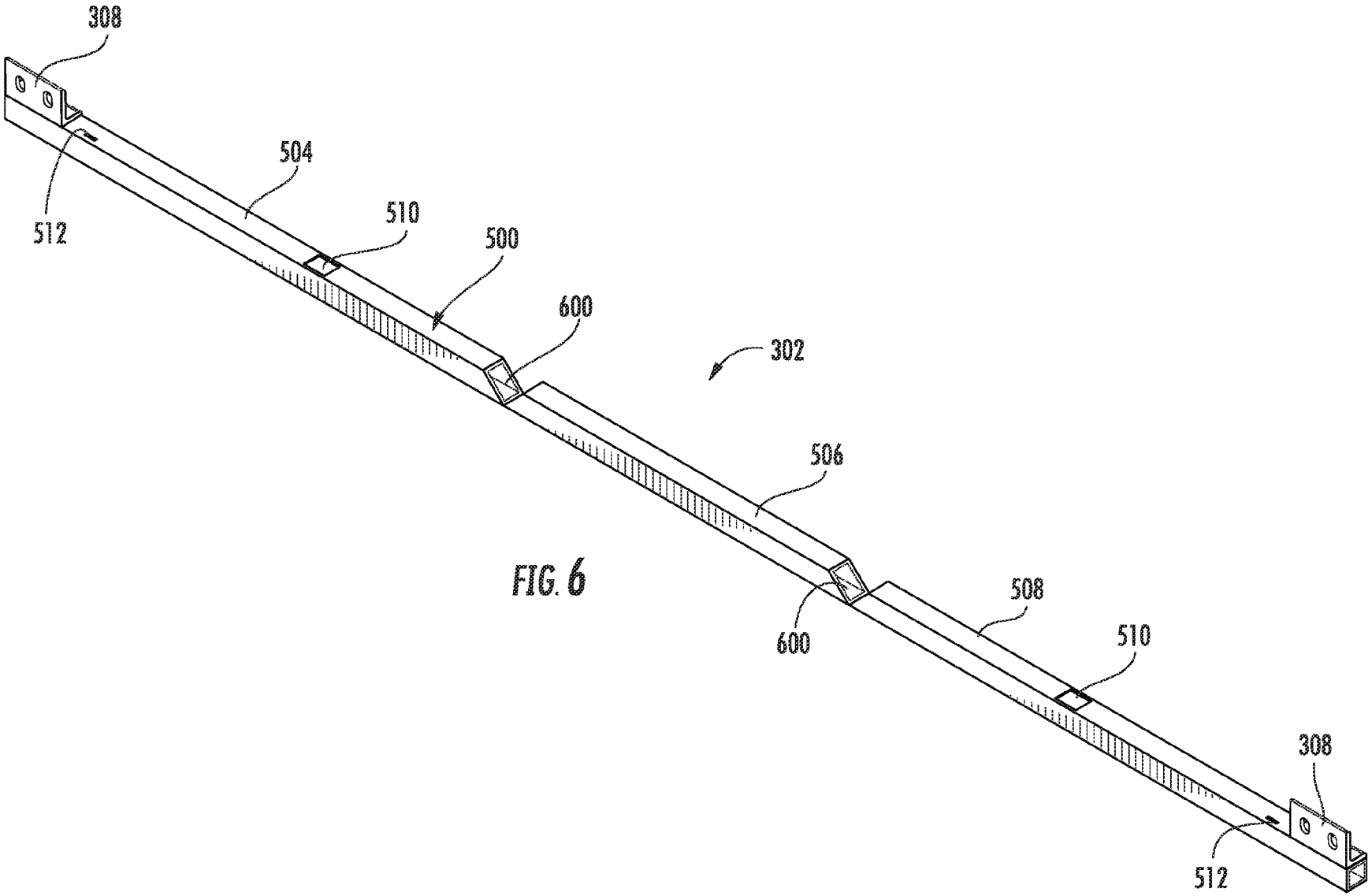
FIG. 6 is a perspective view of the continuous piece of tubular metal of FIG. 5 cut to form the outer rail of the handrail of FIGS. 3 and 4.

FIGS. 5 and 6 illustrate a continuous piece 500 of tubular metal configured to form outer rail 302. Continuous piece 500 of tubular metal is preferably formed of carbon steel, although other suitable materials may be used. The width of the sides of continuous piece 500 of tubular metal is 2 inches, and the thickness is an eighth of an inch. In another embodiment, the width of the sides of continuous piece 500 of tubular metal are 1½ inches wide and one eighth inch thick, although it should be understood that other widths and thicknesses may be employed. Continuous piece 500 is butterflied, notched, lasered, or otherwise cut at two locations (denoted at 502) in order to form two indentations (denoted at 600). Locations 502 define outer rail 302 into portions 504, 506, and 508. Continuous piece 500 is butterflied, notched, lasered, or otherwise cut to define apertures 510 configured to receive portions of midrail 304 (FIGS. 3 and 4) and to define slots 512 configured to receive portions of toeboard 306 (FIGS. 3 and 4), as described in more detail below. Brackets 308 may then be attached to respective portions 504 and 508 of outer rail 302 as illustrated in FIG. 6. It should be understood by those of ordinary skill in the art, however, that the brackets may be welded after outer rail 302 has been folded or after handrail 300 has been formed, as explained below. It should also be understood that brackets 308 may be bolted to outer rail 302 rather than welded.

Figure 7:
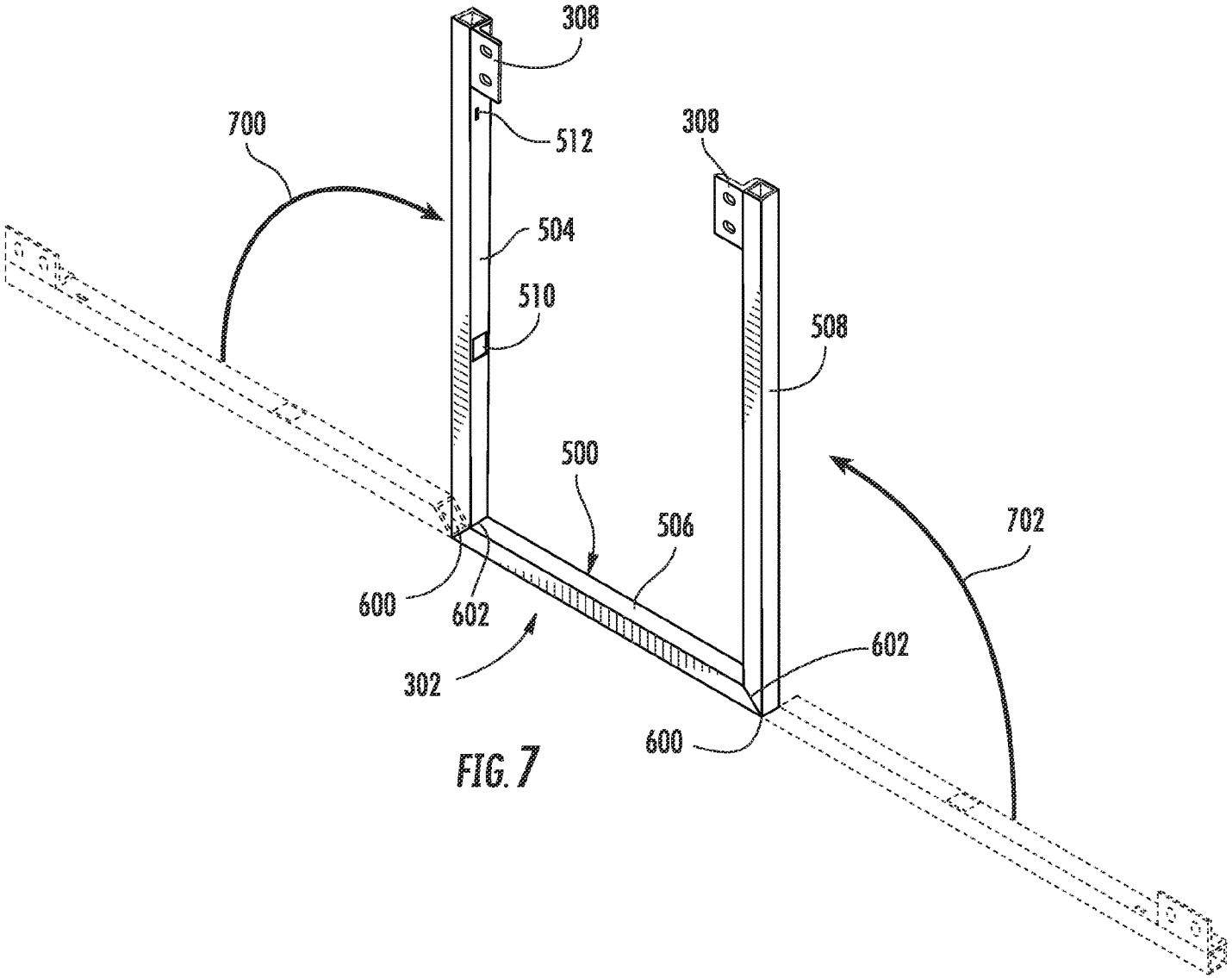
FIG. 7 illustrates an exemplary process for forming of the outer rail of the handrail of FIGS. 3 and 4 from the tubular piece of metal of FIG. 6 in accordance with an embodiment of the present invention.

FIG. 7 illustrates a method for forming outer rail 302 in accordance with an embodiment of the present invention. In operation, portions 504 and 508 of continuous piece 500 of tubular metal are folded inward towards one another at approximately a 90° angle with respect to portion 506 as denoted by respective arrows 700 and 702 in order to form outer rail 302. Optionally, corner intersections (denoted at 602) may be welded for additional stability.

Figure 8:
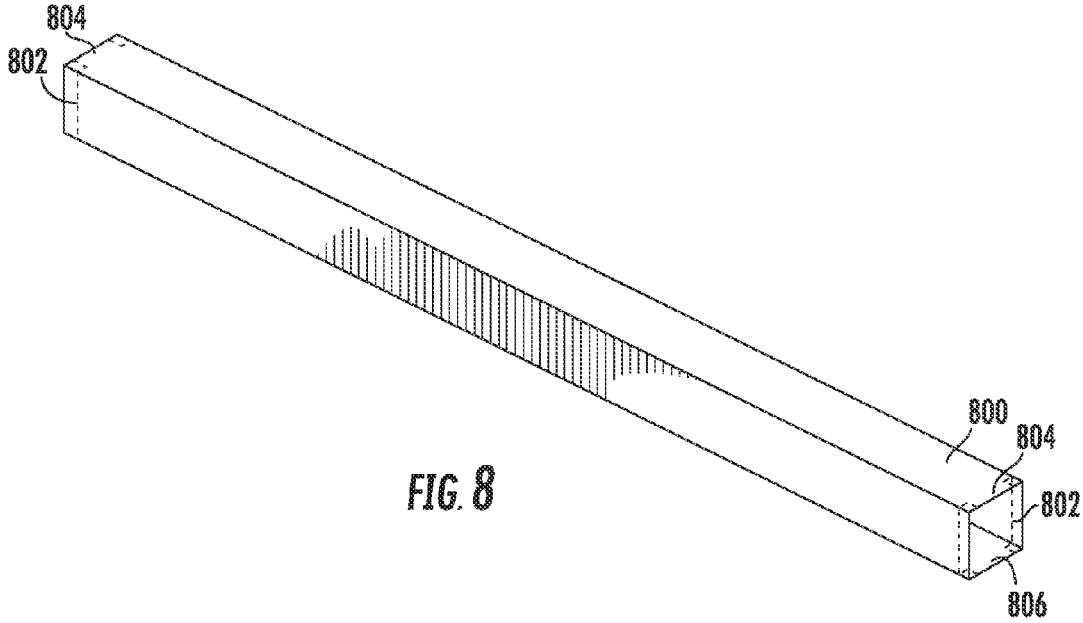
FIG. 8 is a perspective view of a continuous piece of tubular metal used to form the midrail of the handrail of FIGS. 3 and 4.

FIG. 8 illustrates a continuous piece 800 of tubular metal configured to form midrail 304 (FIGS. 3 and 4). Continuous piece 800 is butterflied, notched, lasered, or otherwise cut along dashed lines 802 at the opposite ends of the continuous piece of tubular metal. As a result, tabs 804 and 806 are formed at each distal end of continuous piece 800 of tubular metal.

Figure 9:
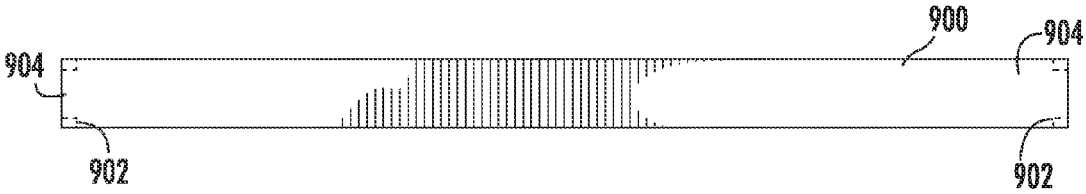
FIG. 9 is a top planar view of a continuous piece of sheet metal used to form the toeboard of the handrail of FIGS. 3 and 4.

FIG. 9 illustrates a continuous piece 900 of sheet metal configured to form toeboard 306 (FIGS. 3 and 4). Continuous piece 900 is butterflied, notched, lasered, or otherwise cut along dashed lines 902 at the opposite ends of the continuous piece of sheet metal. As a result, a pair of tabs 904 are formed at distal ends of continuous piece 900 of sheet metal.

Figure 10:
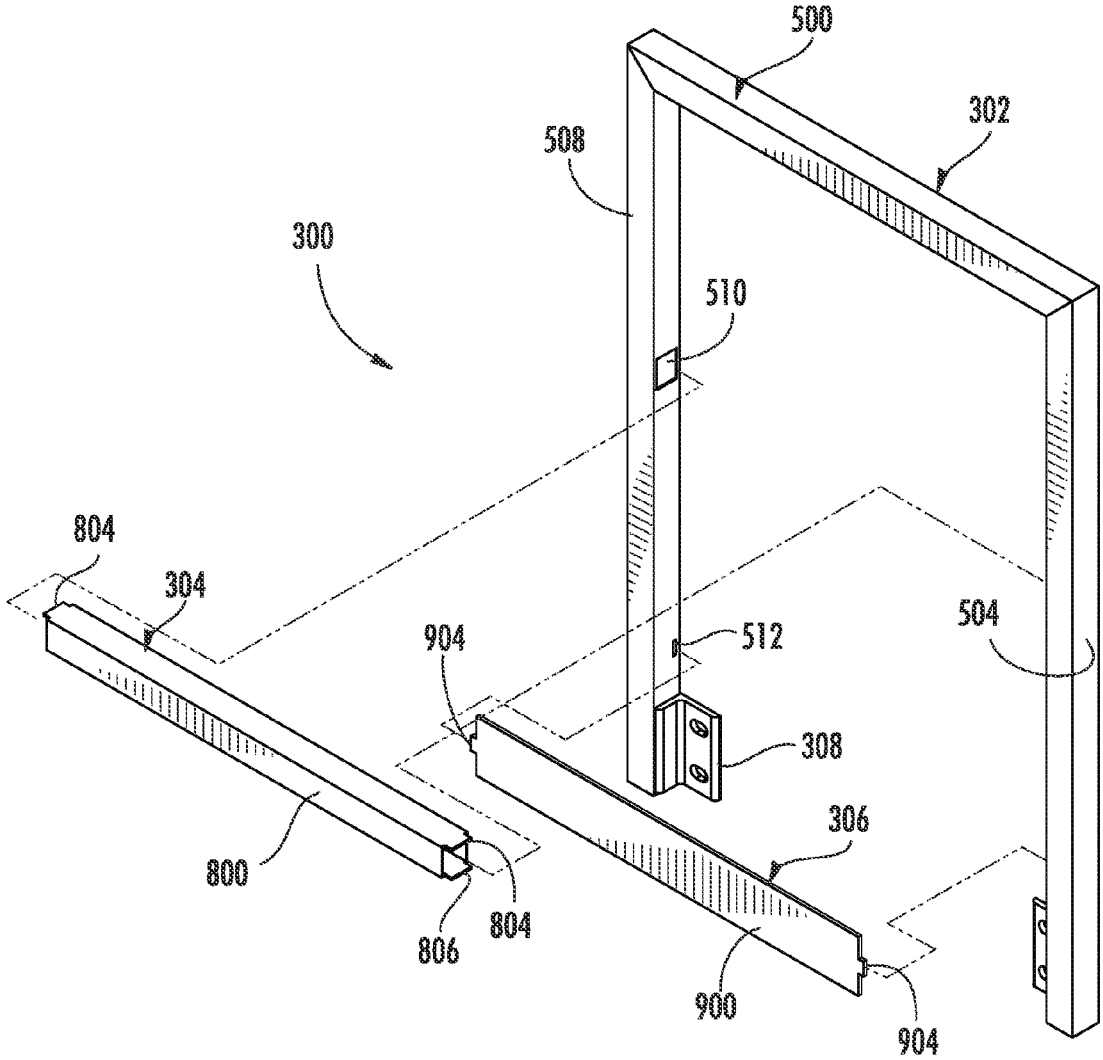
FIG. 10 illustrates an exemplary process for forming the handrail of FIGS. 3 and 4 in accordance with an embodiment of the present invention.

FIG. 10 illustrates an exemplary process for forming handrail 300 (FIGS. 3 and 4). Apertures 510 defined by portions 504 and 508 of outer rail 302 are configured to receive tabs 804 and 806. In another embodiment, each entire distal end of midrail 304 is inserted into a respective aperture 510, so that a portion of each end of the midrail is received into the area defined within outer rail portions 504 and 508, respectively. Slots 512 are configured to receive respective tabs 904. Midrail 304 is connected to outer rail 302 by inserting tabs 804 and 806 into respective apertures 510. Toeboard 306 is connected to outer rail 302 by inserting tabs 904 into respective slots 512. Midrail 304 and toeboard 306 are set into place and connected to outer rail 302 as the outer rail is folded I the manner described above with respect to FIG. 7. That is, portion 504 of outer rail 302 is folded inward at approximately 90° with respect to portion 506. Tabs 804 and 806 of one end of midrail 304 are inserted into aperture 510 defined by portion 504. Likewise tab 904 of one end of toeboard 306 is inserted into slot 512 defined by portion 504. Portion 508 of outer rail 302 is folded inward at approximate 90° with respect to portion 506 toward portion 504 so that tabs 804 and 806 of the other end of midrail 304 are received by aperture 510 defined by portion 508. Likewise, slot 512 of portion 508 receives tab 904 of the other end of the toeboard 306. As noted above, brackets 308 may be attached to outer rail 302 at this point. Handrail 300 is preferably then galvanized, which may also be referred to as hot-dipped galvanization.

Figure 11:
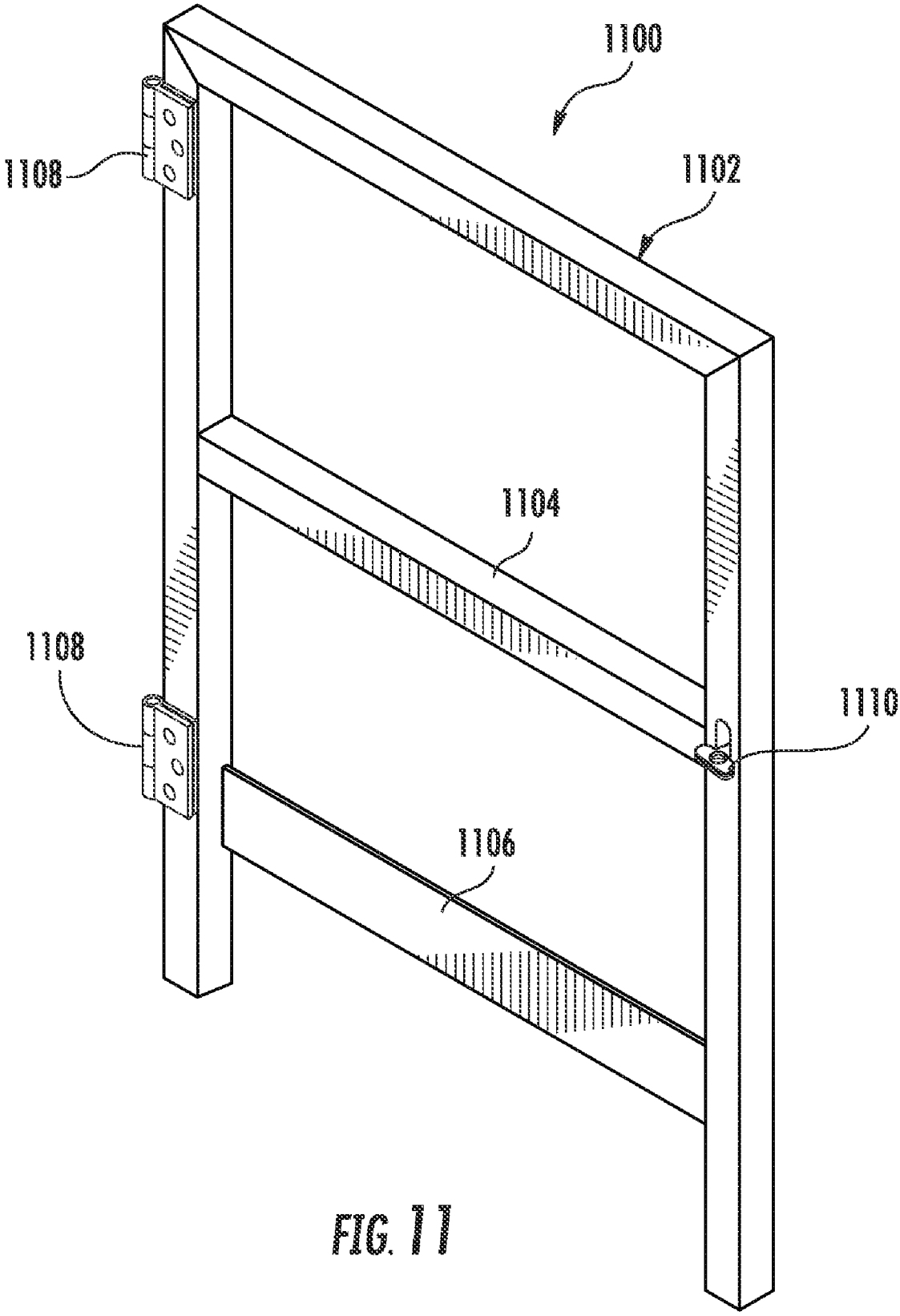
FIG. 11 is a perspective view of a swing gate in accordance with an embodiment of the present invention.

FIG. 11 illustrates a gate or swing gate 1100 in accordance with an embodiment of the present invention. Swing gate 1100 comprises outer rail 1102, midrail 1104, and toeboard 1106. Swing gate 1100 further comprises a pair of hinges 1108 connected to outer rail 1102. Outer rail 1102, midrail 1104, and toeboard 1106 are similar in both construction and formation of outer rail 302, midrail 304, and toeboard 306, respectively, as described above with respect to FIGS. 3 through 9. Likewise, gate 1100 is formed in a manner similar to that of handrail 300 described above with respect to FIGS. 7 and 10.

In operation, swing gate 1100 is attached to another structure, such as a walkway or a handrail, via hinges 1108. Swing gate 1100 may be connected to another structure by an optional latch 1110 or other securing mechanism on the side of the gate opposite hinges 1108. Hinges 1108 allow gate 1100 to rotate with respect to the first structure, while latch 1110 enables a user to secure the swing gate in place. Hinges 1108 may be spring-loaded in order to urge swing gate 1100 back into a closed position after the gate has been opened. In such an embodiment, a tab is preferably attached to the side of outer rail 1102 opposite the side on which hinges 1108 are attached. It should be understood by those of ordinary skill in the art that the tab may either replace latch 1100 of may be located adjacent the latch, such as on the opposite surface of outer rail 1102 from the latch. The tab extends beyond the edge of gate 1100 so that the tab comes in contact with the adjacent structure, such as a handrail, in order to prevent the gate from rotating beyond the desired position as it is urged back to the closed position by hinges 1108.

In an exemplary embodiment, the height of handrail 300 (FIGS. 3 and 4) and of swing gate 1100 (FIG. 11) is approximately 48 inches, but it should be understood that the handrail and gate may be constructed to exhibit various heights and widths depending on the intended use and purpose of each. Accordingly, additional midrails, similar to midrails 304 and 1104 (FIGS. 3 and 11, respectively) may be included to provide additional fall restraint depending on the desired size and configuration of the handrail or swing gate.

Figure 12:
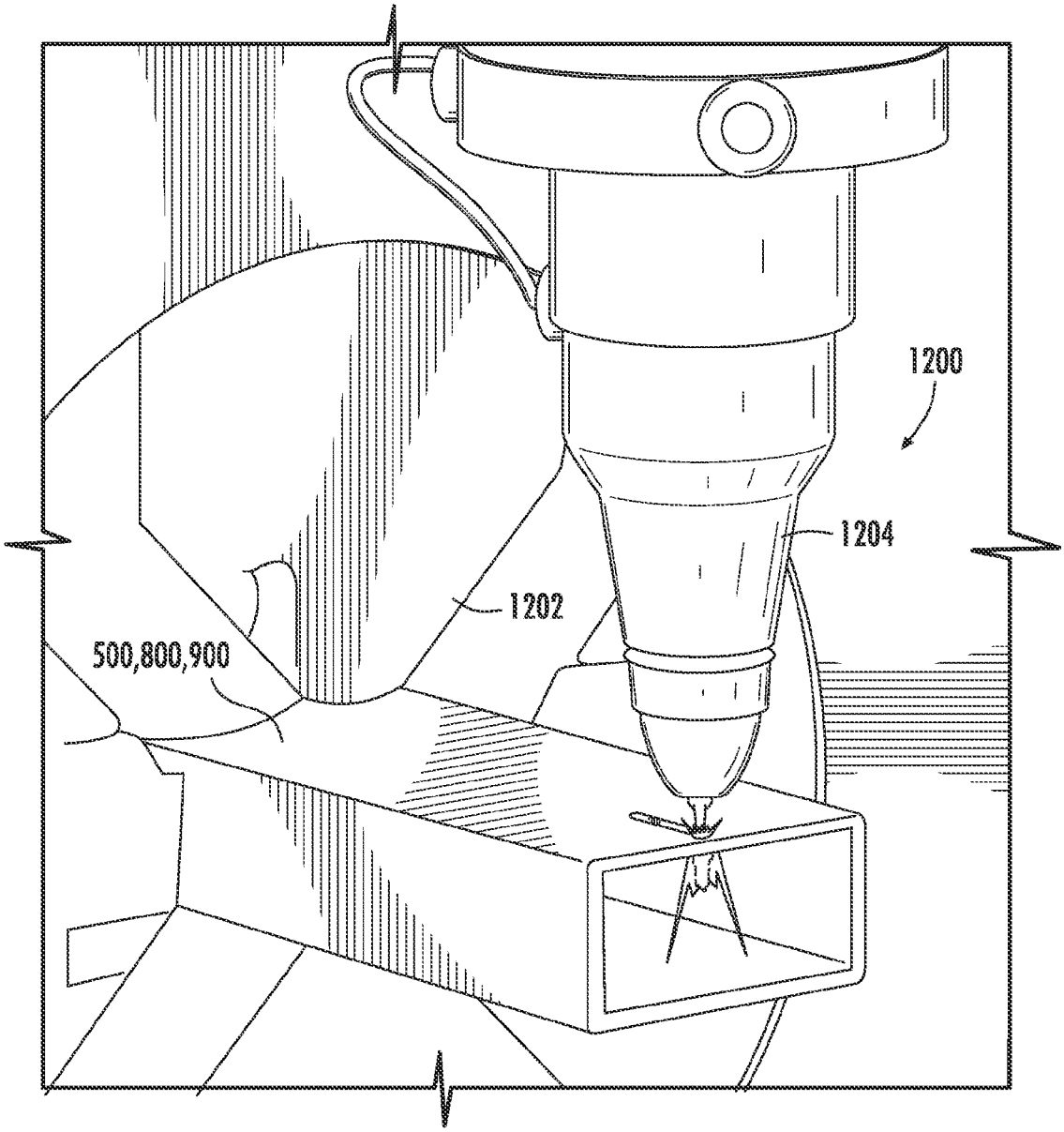
FIG. 12 illustrates an exemplary process for forming the components of the handrail of FIG. 3 and the swing gate of FIG. 11 in accordance with an embodiment of the present invention.

Referring to FIG. 12, a tube laser 1200 may be used to laser or otherwise cut continuous pieces 500 and 800 of tubular metal and continuous piece 900 of sheet metal in order to form outer rail 302, midrail 304, and toeboard 300, respectively. Likewise, tube laser 1200 may be used to cut continuous pieces of tubular and sheet metal configured to form outer rail 1102, midrail 1104, and toeboard 1106. Continuous pieces 500, 800, or 900 of metal is inserted into a holding mechanism 1202 of tube laser 1200, which moves and rotates the continuous piece while a $CO_2$ laser 1204 penetrates the metal. In this manner, tube laser 800 lasers or cuts continuous piece 400 of metal to form the indentations and apertures described above. Tube laser 800 further comprises a processor and a processor-readable medium containing computer instructions that, when executed by the processor, perform the function of providing a graphical user interface ("GUI"). The GUI allows a user to provide tube laser 800 with the desired dimensions of continuous piece 400 of metal and the location and dimensions of the portions of the piece that need to be cut and removed in order to form outer rail 200. Based on these instructions provided by the user, which are stored on the processor-readable medium, the processor instructs tube laser 800, and more specifically, holding mechanism 802 and laser 804, how to rotate, move, and cut continuous piece 400 of metal. It should be understood that other suitable processes may be utilized to cut continuous piece 400 of metal to form outer rail 200, including the use of a cutting drill, a screw machine, or a handheld plasma or flame torch.

Figure 13:
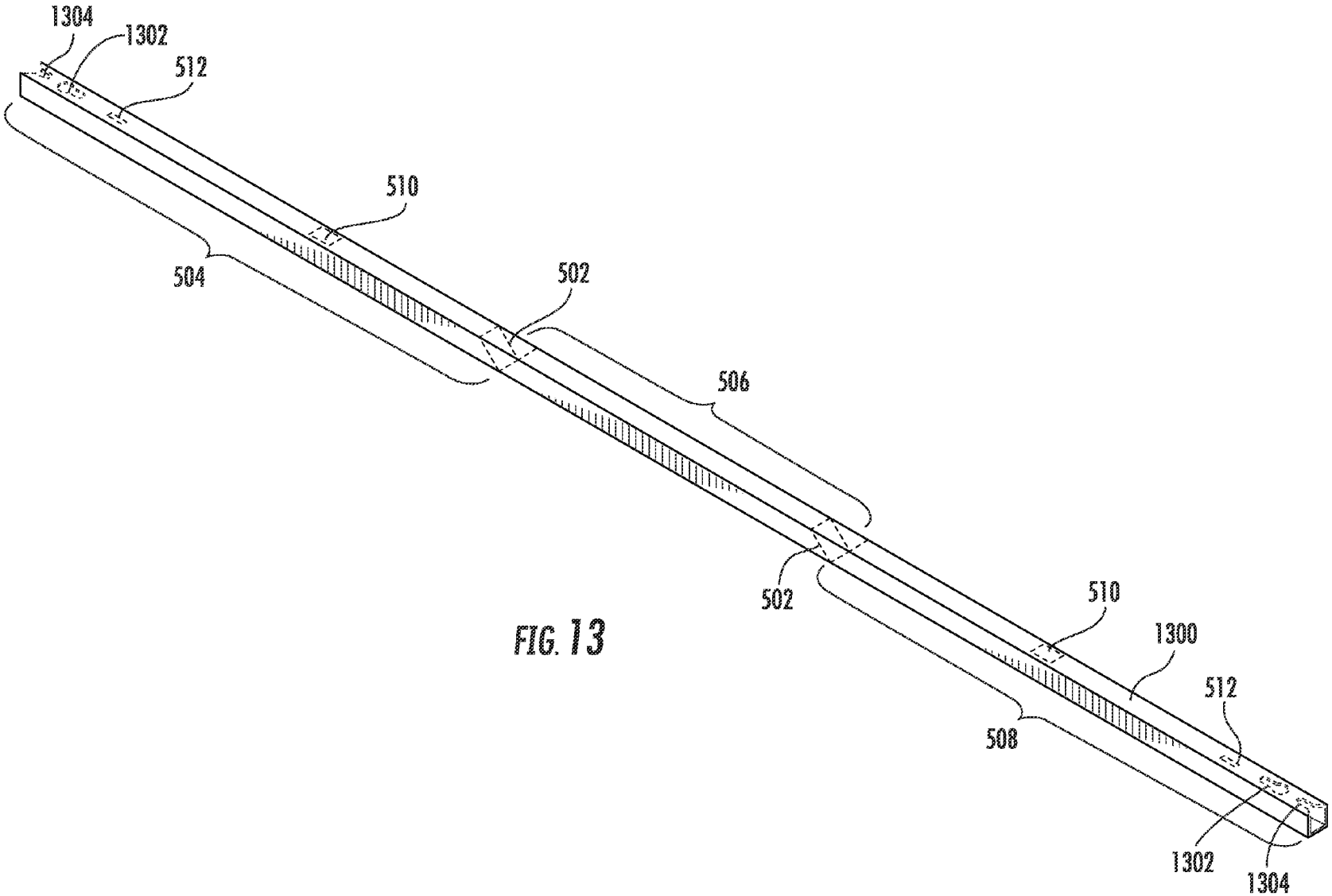
FIG. 13 is a perspective view of a continuous piece of tubular metal configured to form an outer rail of a handrail in accordance with another embodiment of the present invention.

FIG. 13 illustrates a continuous piece 1300 of tubular metal configured to form an outer rail of a handrail in accordance with another embodiment of the present invention. Continuous piece 1300 of tubular metal is similar in shape, size, and construction to continuous piece 500 of tubular metal described above with respect to FIG. 5. For instance, continuous piece 1300 of tubular metal is butterflied, notched, lasered, or otherwise cut along dashed lines 502, 510, and 512. Additionally, however, continuous piece 1300 of tubular metal is also cut along dashed lines 1302 and 1304 at each distal end of the piece of metal. The areas defined by dashed lines 1302 resemble keyhole-shaped apertures, such that the portion nearest to the end of piece 1300, or the "lower" portion, of each area has a greater radius than the portion closest to center portion 506 of the piece of metal. Similarly, the lower portions of the areas defined by dashed lines 1304 exhibit a relatively greater width than the portions nearest to the center of the piece of metal.

Figure 14:
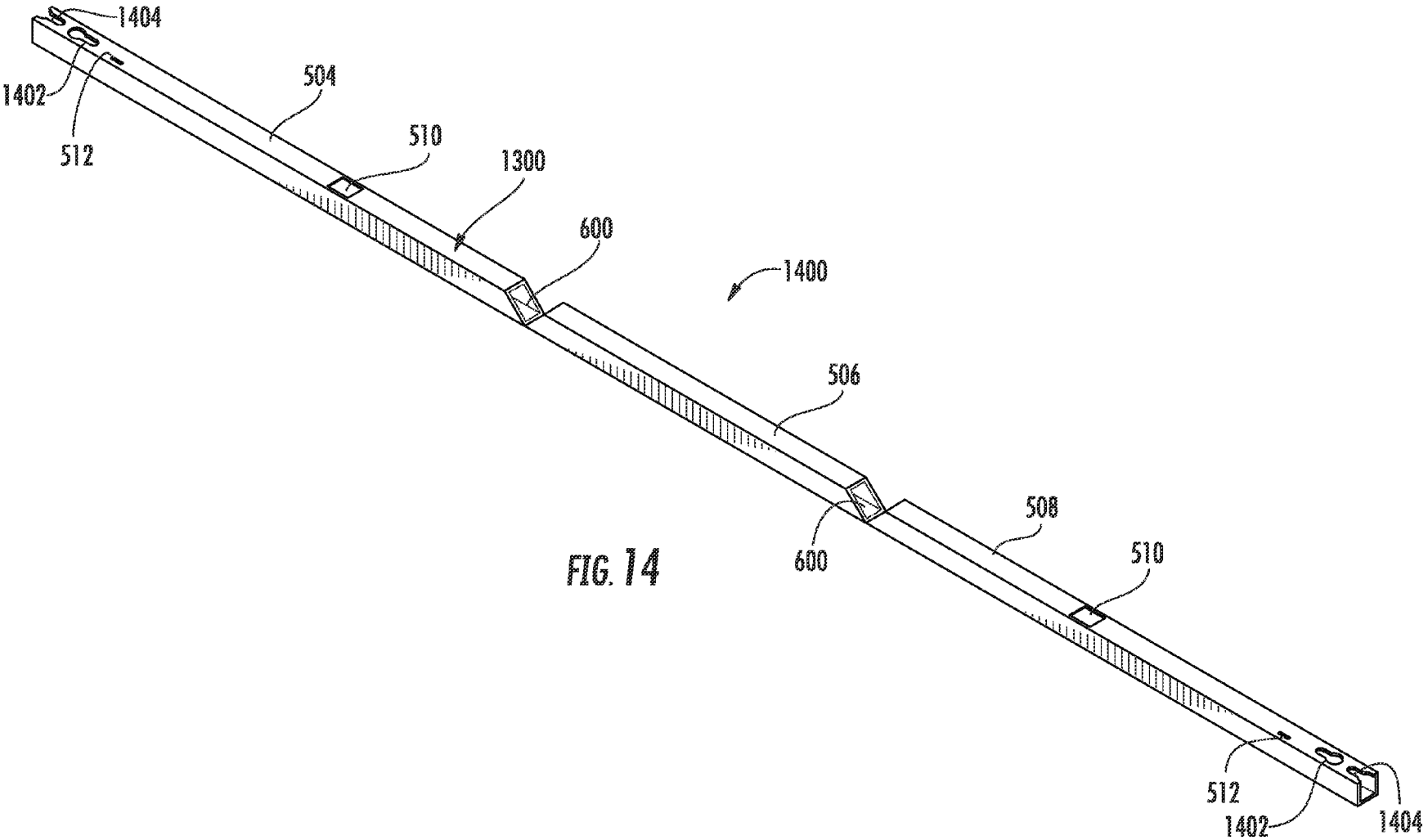
FIG. 14 is a perspective view of the continuous piece of tubular metal of FIG. 13 cut to form the outer rail of a handrail in accordance with another embodiment of the present invention.
Figure 15:
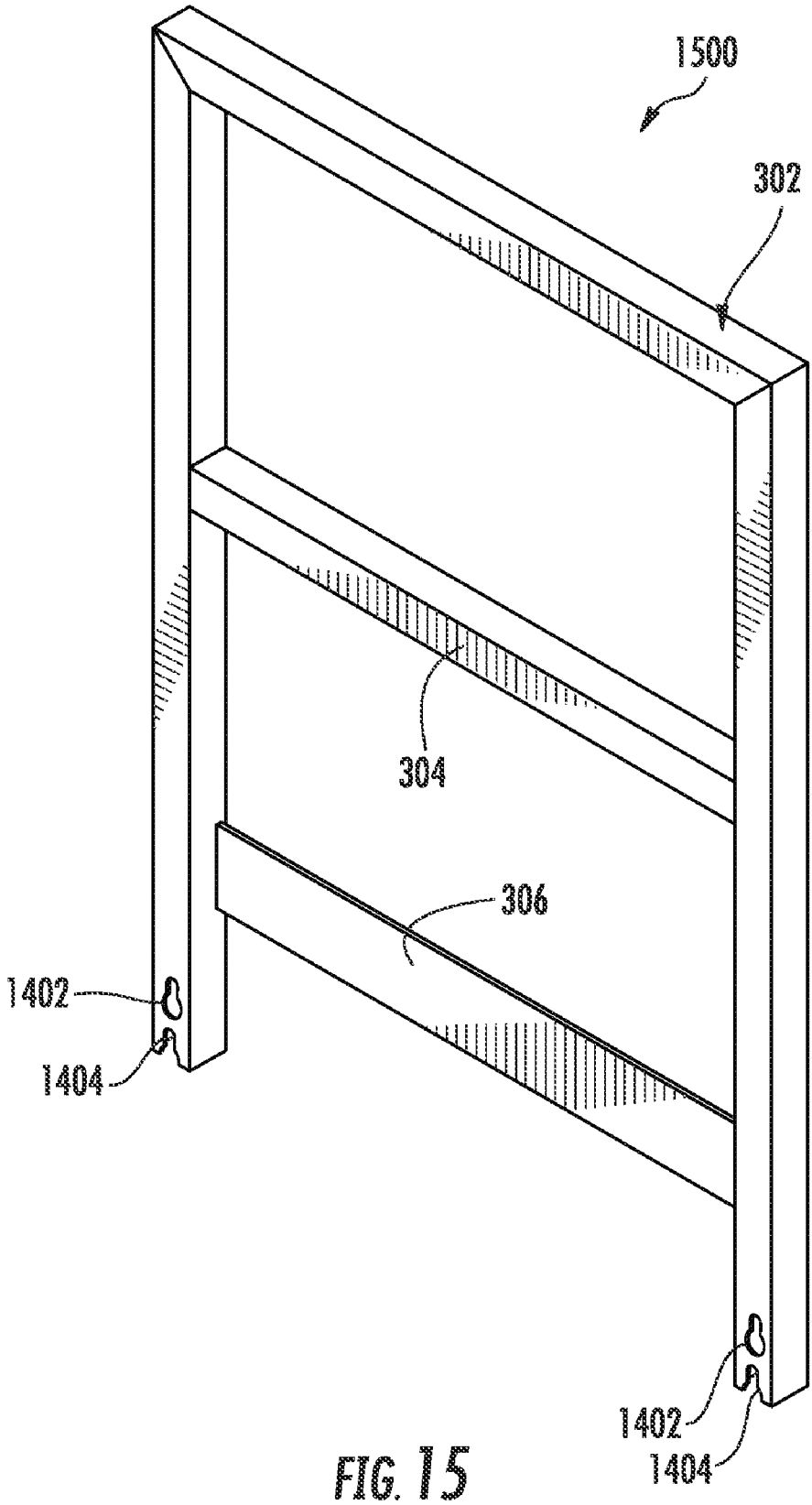
FIG. 15 is a perspective view of a handrail comprising an outer rail formed from the continuous piece of tubular metal of FIG. 14 in accordance with an embodiment of the present invention.

Referring additionally to FIG. 14, continuous piece 1300 of metal is cut to form outer rail 1400 in a manner similar to that described above with respect to outer rail 302 of FIGS. 5 and 6. That is, continuous piece 1300 of tubular metal is cut along dashed lines 512, 510, and 502 in order to define apertures 512, 510, and 600, respectively. Likewise, continuous piece 1300 of tubular metal is cut along dashed lines 1302 and 1304 to define areas 1402 and 1404, respectively. The lower portions of each area 1402 and 1404 are configured to receive the head of respective bolts as explained in more detail below.

Outer rail 1400 is then folded in a manner similar to that described above with respect to FIG. 7. Likewise, handrail 1500 is formed from outer rail 1400, midrail 304, and toeboard 306 in a manner similar to that described above with respect to FIG. 10. Those of ordinary skill in the art should understand that brackets 308 (FIGS. 7 and 10) are not attached, however, to outer rail 1400 or handrail 1500 in this embodiment.

Figure 16:
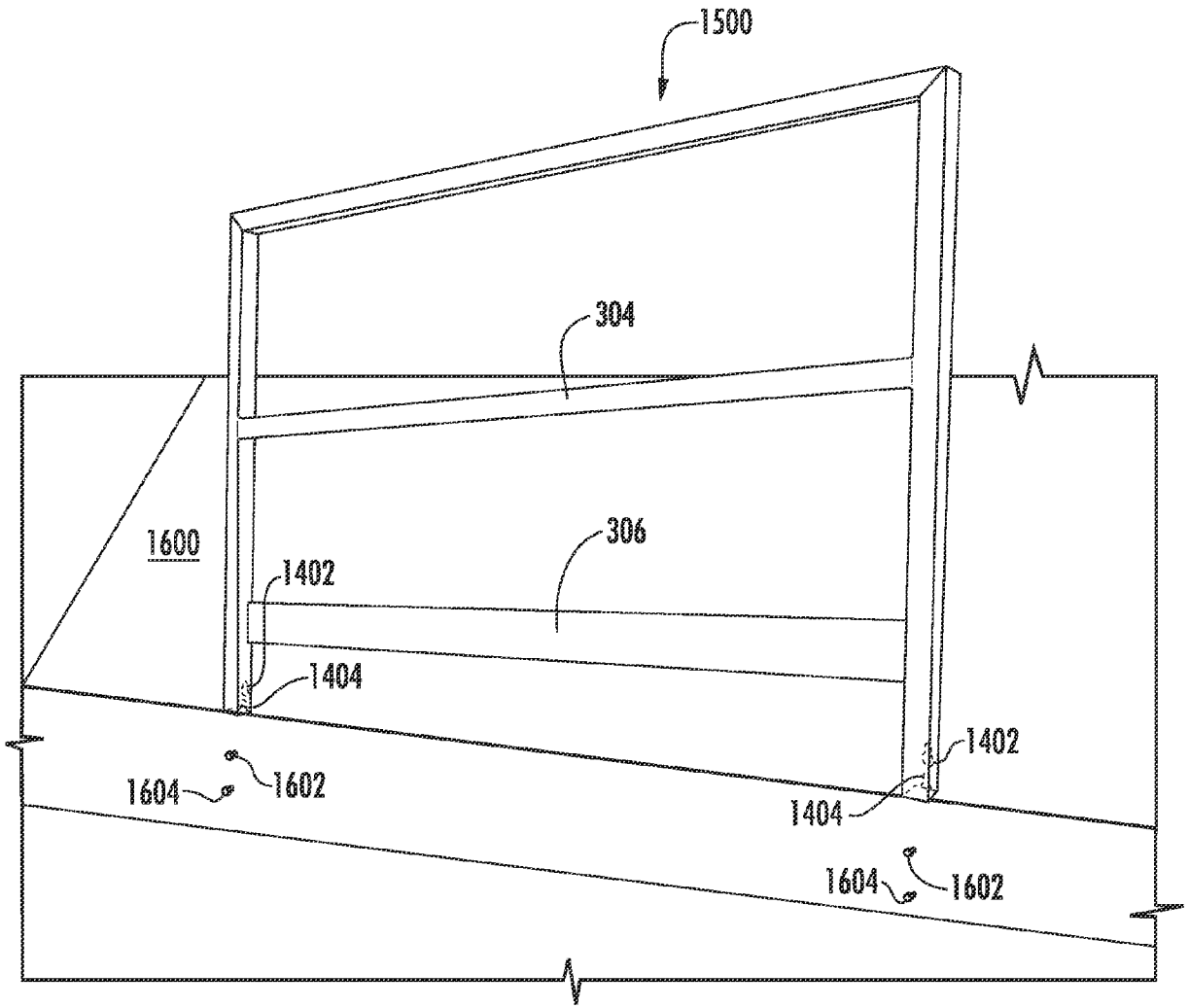
FIGS. 16 through 18 illustrate an exemplary process for attaching a handrail to a fixed structure in accordance with an embodiment of the present invention.
Figure 17A:
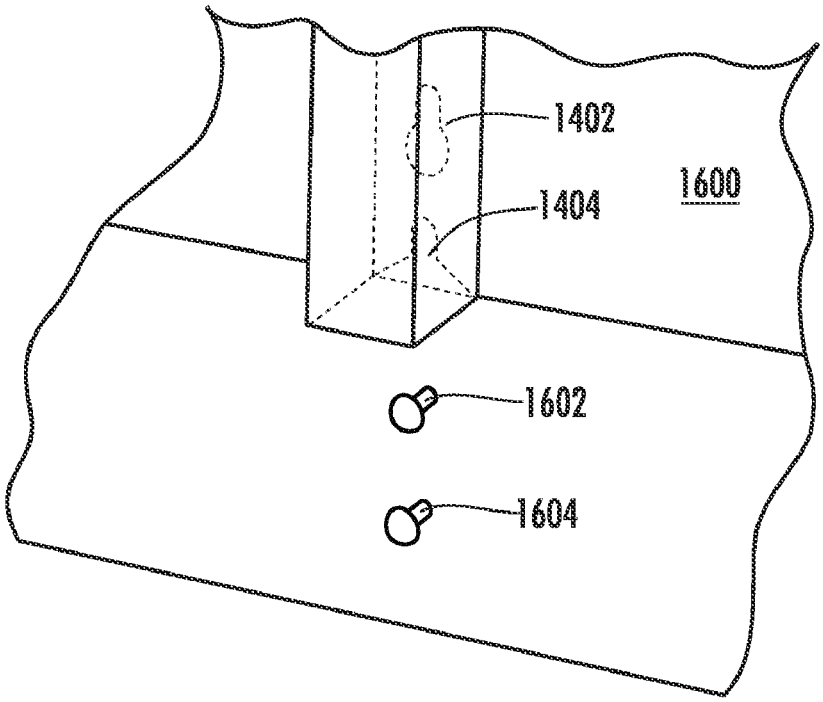
Figure 17B:
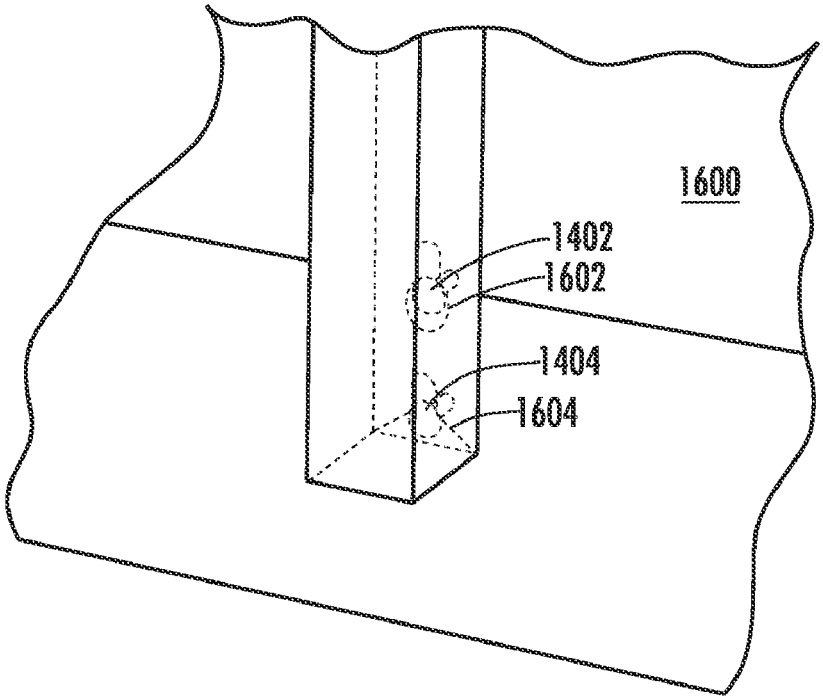
Figure 17C:
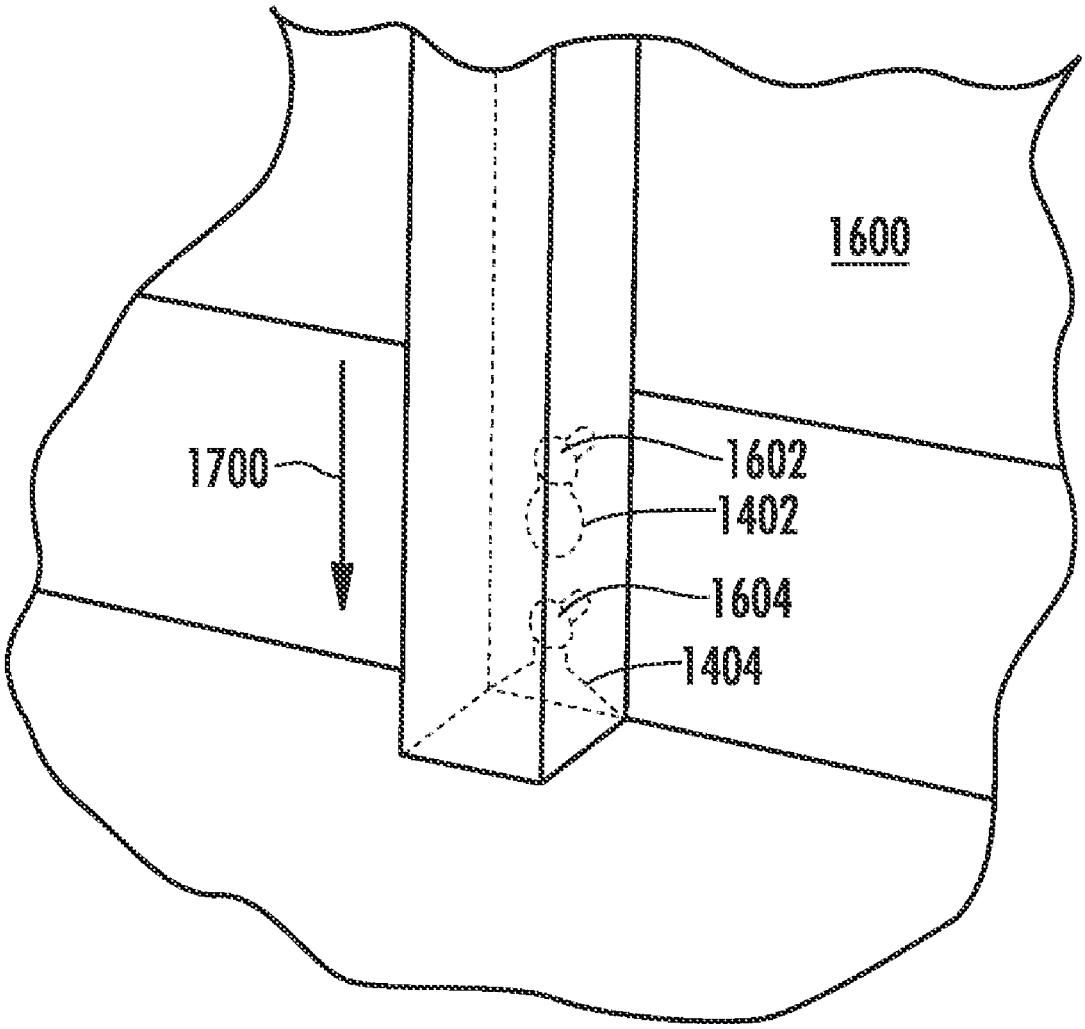
Figure 18:
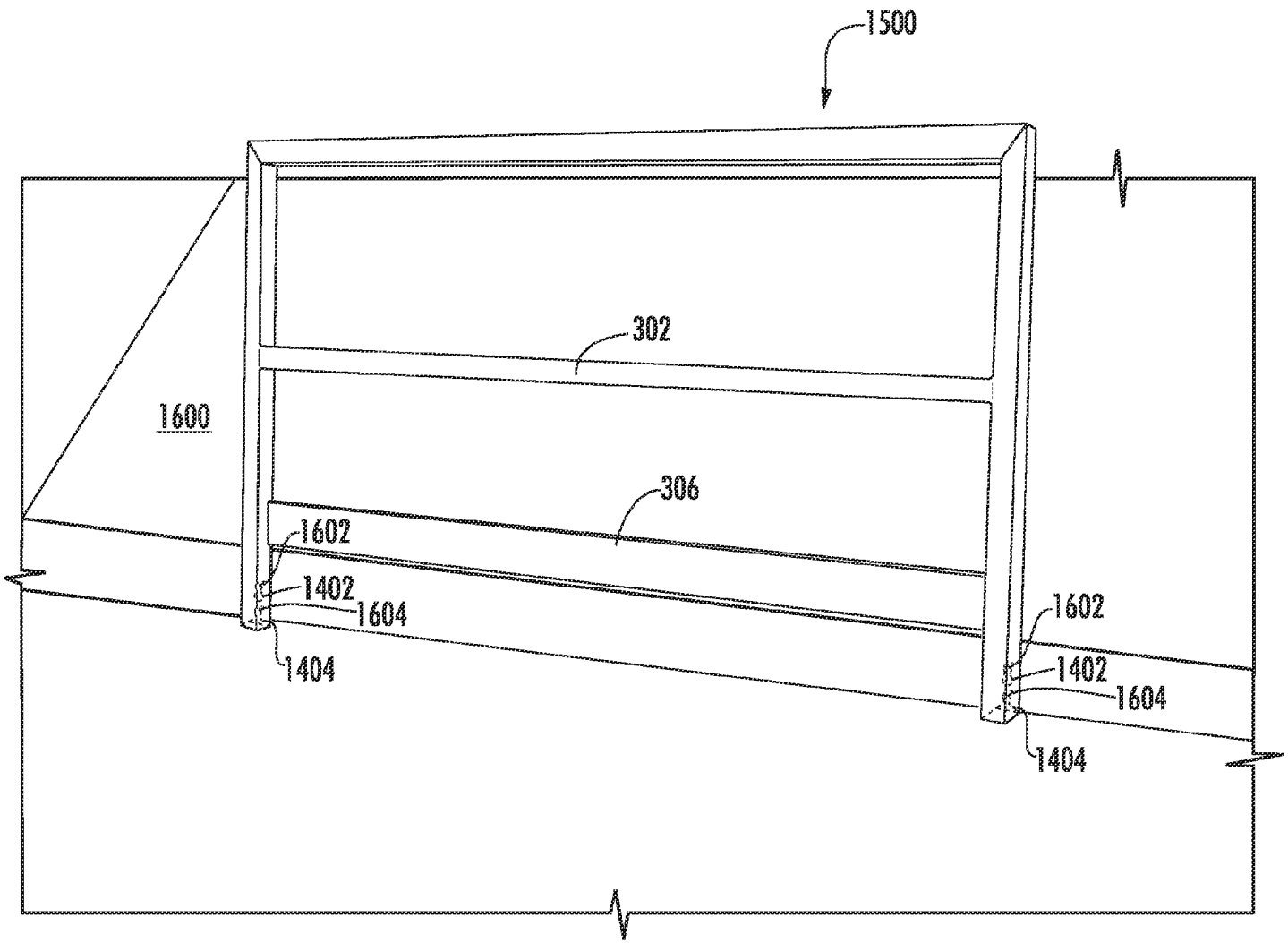

Referring to FIGS. 16 through 18, handrail 1500 is positioned adjacent a fixed structure 1600 in order to mount the handrail to the structure. A pair of bolts is attached to fixed structure 1600 at locations corresponding to the distal ends of handrail 1500 that define areas 1402 and 1404. Each bolt attached to structure 1600 is threaded and configured to receive a respective nut. In the example provided by FIGS. 16 through 18, a combination 1602 of a nut and bolt is located vertically above a combination 1604 of another nut and bolt on a front surface of structure 1600. The lower portions of areas 1402 and 1404 are configured to receive the combinations 1602 and 1604 of the nuts and bolts, respectively.

In operation, handrail 1500 is positioned so that areas 1402 and 1404 are located near combinations 1602 and 1604 as illustrated in FIG. 17A. Handrail 1500 is then positioned so that combinations 1602 and 1604 are received by the lower portions of areas 1402 and 1404, respectively, as illustrated in FIG. 17B. In this regard, the nut portion of each combination extends into the interior of continuous piece 1300 of tubular metal of handrail 1500 beyond the surface of the handrail defining the two areas. Next, handrail 1500 is lowered until the top portion of areas 1402 and 1404 rest on the bolt portions of combinations 1602 and 1604, respectively, as denoted by arrow 1700 in FIG. 17C. As a result, combinations 1602 and 1604 of the nuts and bolts slide into the respective upper portions of areas 1402 and 1404. That is, the edges defining the upper portions of areas 1402 and 1404 engage and separate the nut portion of combinations 1602 and 1604, respectively, from the surface of structure 1600 to which the bolts are affixed. Those of ordinary skill in the art should appreciate that handrail 1500 is thus affixed to structure 1600 as illustrated in FIG. 18 due to the relatively greater circumference exhibited by the nuts of combinations 1602 and 1604 than the circumference exhibited by the upper, relatively narrower portions of areas 1402 and 1404. That is, it should be understood that the upper portions of areas 1402 and 1404 are configured to prevent the nuts of combinations 1602 and 1604 from passing through the upper portions. The force exerted by gravity on handrail 1500 maintains the handrail in a lowered, fixed position. The sides of areas 1402 and 1404 continue to engage the nuts of combinations 1602 and 1604, respectively.

It should be understood by those of ordinary skill in the art that the above description discloses a process for manufacturing a handrail or a swing gate from a continuous pieces of metal. The outer rail of the handrail or swing gate is notched or indented at two locations and then folded at the indentations. During manufacture, the outer rail is also notched in order to allow areas of additional pieces to be inserted into the outer rail to provide for a complete connection between the two. The additional pieces and the outer rail may be welded together if desired. It should be apparent that forming a handrail or swing gate in the manner described above reduces the amount of time and materials required in comparison to convention handrails and swing gates, thereby lowering the overall cost of the product.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

The invention claimed is:

1. A method for manufacturing a rail, wherein the rail comprises an outer rail, the method comprising:

providing a first continuous piece of tubular metal configured to be the outer rail, the first continuous piece of tubular metal having a first end and a second end, the first end comprising a first connecting portion configured to attach the first continuous piece of tubular metal to a platform structure, the second end comprising a second connecting portion configured to attach the first continuous piece of tubular metal to the platform structure, the platform structure being configured to allow a person to walk or stand thereon;

cutting out a first portion of the first continuous piece of tubular metal to define a left indentation between a left portion and a middle portion of the first continuous piece of metal;

cutting out a second portion of the first continuous piece of metal to define a right indentation between the middle portion and a right portion of the first continuous piece of tubular metal, wherein the left and right indentions are the only indentations in the first continuous piece of tubular metal;

folding the left portion with respect to the middle portion at the left indentation;

folding the right portion with respect to the middle portion at the right indentation;

attaching the first connecting portion to the platform structure at a first location so that the left portion is attached to the platform structure; and attaching the second connecting portion to the platform structure at a second location so that the right portion is attached to the platform structure, wherein the first location is separate from the second location.

2. The method of claim 1, wherein:

the rail further comprises a midrail, the method further comprising connecting the midrail to the outer rail.

3. The method of claim 2, further comprising:

providing a second continuous piece of tubular metal configured to be the midrail.

4. The method of 3, further comprising:

cutting the first continuous piece of tubular metal to define a pair of apertures in the outer rail, wherein the step of connecting the midrail to the outer rail comprises inserting each end of the midrail into each respective aperture defined by the outer rail.

5. The method of claim 4 further comprising:

cutting the second continuous piece of tubular metal to define a pair of tabs on each end of the midrail, wherein the step of connecting the midrail to the other rail further comprises inserting each of the pair of tabs on each end of the midrail into each respective aperture defined by the outer rail.

6. The method of claim 1 further comprising:

connecting a toeboard to the outer rail; and providing a continuous piece of sheet metal configured to be the toeboard.

7. The method of claim 6 further comprising:

cutting the continuous piece of sheet metal to define a tab on each distal end of the toeboard; and cutting the first continuous piece of tubular metal to define a pair of slots in the outer rail, wherein the step of connecting the toeboard to the outer rail comprises inserting each tab of the toeboard into each respective slot defined by the outer rail.

8. The method of claim 1 further comprising:

connecting at least one bracket to the rail.

9. The method of claim 1 further comprising:

connecting at least one hinge to the rail.

10. The method of claim 9 further comprising:

connecting a latch to the rail.

11. The method of claim 1 further comprising:

connecting the rail as a handrail to a structure.

12. The method of claim 1 further comprising:

connecting the rail as a swing gate to a structure.

13. A handrail comprising:

a top horizontal portion;

a left vertical portion connected to a left end of the top horizontal portion, the left vertical portion comprises a first end; and a right vertical portion connected to a right end of the top horizontal portion, the right vertical portion comprises a second end, wherein a base portion of each of the left and right vertical portions defines at least one aperture having a lower portion and an upper portion, the lower portion exhibiting a relatively greater circumference than that of the upper portion so that a fixture comprising a first part and a second part, wherein the second part exhibits a lesser circumference than the upper and lower portions and a first part exhibiting a lesser circumference than the lower portion but greater than the upper portion, may be received by the lower portion but is unable to pass through the upper portion, wherein the first end comprises a first connecting portion configured to attach the left vertical portion of tubular metal to a platform structure, the second end comprising a second connecting portion configured to attach the right vertical portion to the platform structure, the platform structure being configured to allow a person to walk or stand thereon.

14. The handrail of claim 13 comprising:

a middle vertical portion connected between the left and right vertical portions.

15. The handrail of claim 13 wherein:

the left vertical portion, the top horizontal portion, and the right vertical portion are formed from one continuous piece of tubular metal.

16. The handrail of claim 13 wherein:

the at least one aperture defined by each base of the left and right vertical portions comprises a lower aperture and an upper aperture, wherein the upper aperture is located directly above the lower aperture.

17. The handrail of claim 16 wherein:

the lower portion of the upper aperture is generally circular while the upper portion is generally cylindrical such that the upper aperture resembles an inverted keyhole.

* * * * *